United States Patent [19]

Barrett

[11] Patent Number: 4,569,403

[45] Date of Patent: Feb. 11, 1986

[54] FORMATION SAMPLING BULLET

[75] Inventor: Bracell P. Barrett, Houston, Tex.

[73] Assignee: Barrett Machine Works, Bellaire, Tex.

[21] Appl. No.: 640,307

[22] Filed: Aug. 13, 1984

Related U.S. Application Data

[63] Continuation of Ser. No. 410,524, Aug. 23, 1982, abandoned.

[51] Int. Cl.[4] ..... E21B 49/02

[52] U.S. Cl. ..... 175/4; 175/58; 175/405

[58] Field of Search ..... 175/4, 58, 403, 405

[56] References Cited

U.S. PATENT DOCUMENTS

| | | | |
|---|---|---|---|
| 2,389,208 | 11/1945 | Orr | 175/405 |
| 2,775,427 | 12/1956 | Leone | 175/4 |
| 2,848,194 | 8/1958 | Porter | 175/4 |
| 3,101,797 | 8/1963 | Brieger | 175/4 |
| 3,197,894 | 8/1965 | Ratkowski | 285/404 |
| 3,220,493 | 11/1965 | Urbanosky | 175/4 |
| 3,329,217 | 7/1967 | Urbanosky | 175/4 |
| 4,280,568 | 7/1981 | McPhee et al. | 175/4 |

FOREIGN PATENT DOCUMENTS

| | | | |
|---|---|---|---|
| 204981 | 2/1959 | Austria | 175/403 |
| 268170 | 3/1968 | Austria | 175/4 |

*Primary Examiner*—Stephen J. Novosad
*Assistant Examiner*—M. Goodwin
*Attorney, Agent, or Firm*—Gunn, Lee & Jackson

[57] ABSTRACT

Sampling bullets of the type which are fired into rock formations adjacent a well bore. Surprising and unexpected increases in the service life of the bullet and reliability in obtaining and retrieving core samples have been achieved.

11 Claims, 9 Drawing Figures

50a
52
50
52a
61
60
45
C
42

46
40
90
98
B-2
96
94
92
38
68
64

C
46
40
44
34
34
10
38
36
32
30
24
20
18
16
14
4
4
10a
12
B-1
68
66
64
28
26

30
14
16
28
32
12
10

24b
24

24a
24
22
20
18

FORMATION SAMPLING BULLET

SPECIFICATION

This is a continuation of application Ser. No. 410,524 filed Aug. 23, 1982, now abandoned.

BACKGROUND OF THE INVENTION

1. Field of Invention

The present invention relates to bullets for obtaining cores or samples from formations adjacent to well bores.

2. Description of Prior Art

In petroleum exploration, it is desirable to determine the nature and composition of rock formations at various depths in a well bore. On way of doing so has been the use of sampling bullets. Typically, a number of such bullets are mounted with associated explosive charges on a sampling tool for movement through the well bore.

At a selected depth, the charge for one or more of the bullets is ignited, firing the bullet into the rock formation. The bullet is provided with a center opening or passage which gathers a core or sample of the formation rock as the bullet enters. The bullet enters the rock a distance of about one inch but is kept connected to the tool by wire cables. When the tool is moved away from the formation, the bullet is extracted from the formation and hangs from the tool. After all bullets have been fired, the cores in them may be transported by the tool to the surface for analysis.

Applicant has been making and supplying bullets for a number of years for a major oil well service company. Although satisfactory for most purposes, these types of bullets had a relatively short service life due to severe service conditions present when the bullet was fired into the rock formations.

After ten or so firings, the bullets were likely to break or fracture on any future shot. If the bullet broke in service, either no core was obtained or the core sample fell loose during movement of the sampling tool to the surface. Further, bullet failure was undetected until the sampling tool was pulled to the surface, so that additional runs of the sampling tool into the well bore were required. Further, even where the bullet satisfactorily entered the formation and did not fracture or break, the core would work loose from the bullet during tool movement of the sampling tool in the well bore so that the core could not be recovered.

SUMMARY OF INVENTION

Briefly, the present invention provides new and improved formation sampling bullets which are adapted to be fired by explosive charges from a sampling tool into an earth formation adjacent a well borehole to obtain formation samples or cores. Several changes have been made from previous bullets which afford surprising and unexpected increases in service life of the bullets, as well as other advantages. The structure of the bullets forming the side walls of the sample core receiving barrel has been modified so that the sample core may more easily pass into, and be retained in, the bullet. Also, subsequent removal of the sample core from the bullet is facilitated. It also appears that less explosive charge is needed. The shape of the nose of the bullets has also been changed from the relatively sharp and thin cutting edges thought desirable to a rounded or more relatively blunt shape. These types of modifications have been found to exhibit unexpected increases in service life and core retention especially in very hard formations. The external shape of the bullets has also been changed to permit more ready entry of the bullets into the formation and ease of removal of the bullets and cores from the formation.

Finally, in one embodiment of the invention, a bullet with a changeable nose is provided. A carrier cup includes a rear charge cup and a mounting socket. The changeable nose may be any of the shapes of increased service life nose members of the present invention, and is also provided with a connector collar which is releasably attached to the carrier cup. The carrier cup also has external structural features of the other sampling bullets, while the changeable noise also has side walls in its core receiving barrel according to the present invention.

DESCRIPTION OF THE PREFERRED EMBODIMENT

Figures 1, 2, 3, 4, 5, 6:
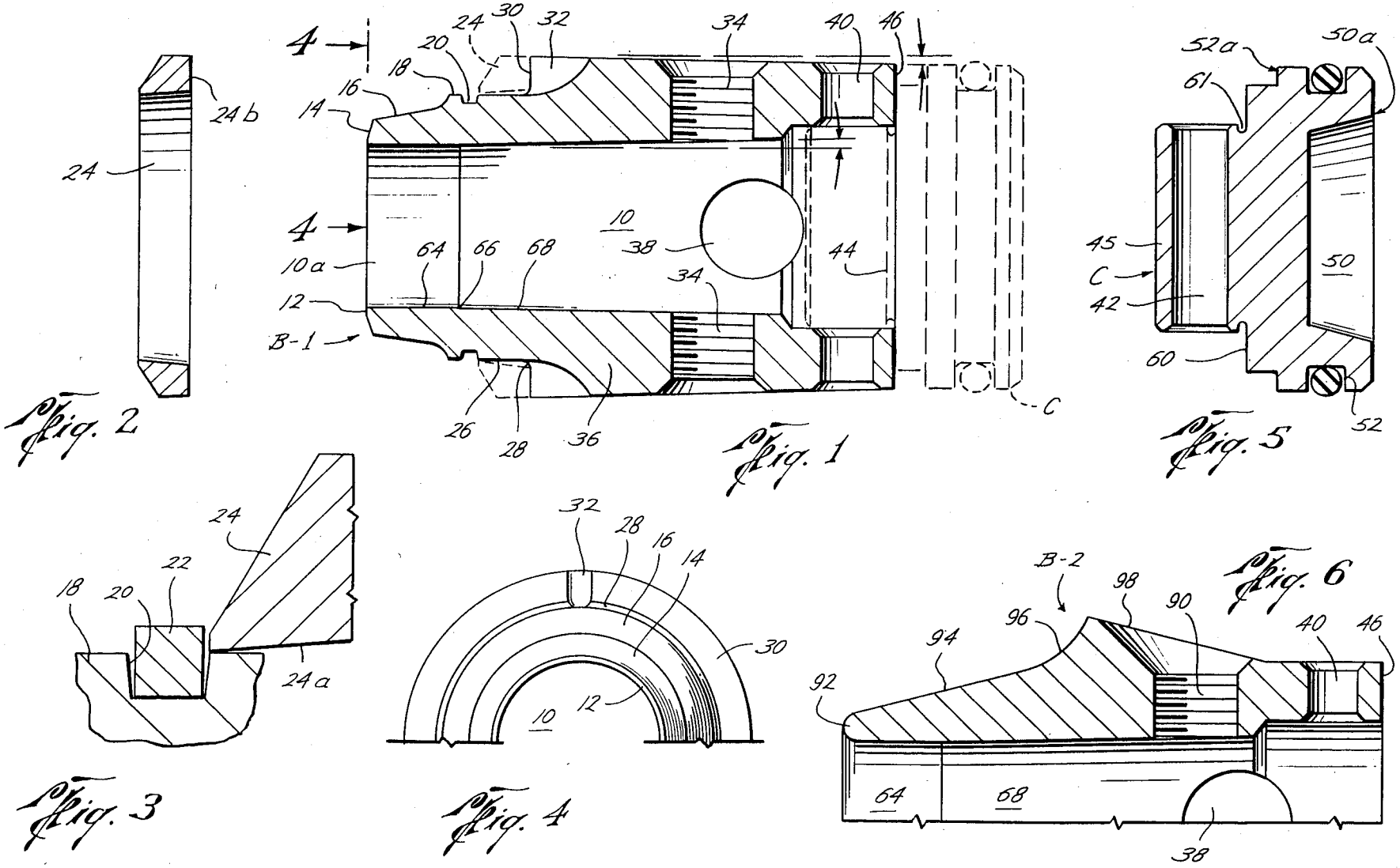
FIG. 1 is an elevation view, taken in cross-section, of a first core sampling bullet according to the present invention.
FIG. 2 is an elevation view, taken in cross-section, of a release ring used with core sampling bullets of the present invention.
FIG. 3 is an enlarged cross-sectional view of an attaching technique for the release ring of FIG. 2.
FIG. 4 is a view taken along the lines 4—4 of FIG. 1.
FIG. 5 is an elevation view, taken in cross-section, of a tail plug used with the sampling bullets of the present invention.
FIGS. 6, 7 and 8 are elevation views, taken in cross-section of other core sampling bullets of the present invention.

In the drawings, the letter B-1 designates generally a first type of formation sampling bullet in accordance with the present invention. The bullet B-1 is adapted to be connected by wire cables to, and fired from, a conventional core sampling tool which is moved by a wireline or other mechanism to various depths in a wellbore. When located at a selected depth adjacent to a formation of interest, an explosive charge in the sampling tool is detonated, as is conventional, and the bullet B-1 is fired into the rock formation. A core or sample of the formation rock is forced into a central opening or core barrel 10 of the bullet B-1 as the formation rock is entered. Typically a penetration of one inch or slightly more into the formation by the bullet occurs for a conventional explosive charge.

After a number of the bullets have been fired at selected locations in the well borehole, the sampling tool is then withdrawn from the borehole. As this occurs, the bullets B are then extracted from the formation by means of the wire cable connection and the core in the bullet transported to the surface by the sampling tool connection. The core is then forced from the bullet B-1 by a rod or plunger under suitable force, so that analysis can be performed on the sample to investigate geological conditions of interest. As has been detailed with respect to the prior art, the short service life and breakage at unexpected times of bullets has been a problem. With the present invention, applicant has found that surprising and unexpected increases in service life of formation sampling bullets can be obtained.

Bullets of the present invention are preferably made from shock resistant steel.

Considering the first embodiment B-1 of the bullets of the present invention more in detail, a contact flat 12 is formed on a nose or front portion adjacent to a front portion 10*a* of the core barrel 10. The flat portion 12 functions better than a knife or pointed edge, since it is less likely to crack or chip on contact with the formation rock. Further, minor chips in the flat portion 12 do not lead as readily to bullet failure. A wedge or sloping surface 14 extends outwardly at an angle, typically of approximately twenty degrees, from the flat surface 12. The surface 14 forms a cutting blade surface and allows penetration of the bullet B-1 into the rock formation. The surface 14 also serves to cause a compressive action to be transferred from the rock to the bullet B-1 as entry occurs. A trailing surface 16 extends between the wedge surface 14 and a shoulder 18, behind which is formed an annular groove 20 for receipt of a snap or retainer ring 22. It is also to be noted, for reasons to be set forth below, that the trailing surface 16 is not cylindrical, but rather tapers outwardly along its extent between the shoulder 18 and wedge surface 14.

The snap ring 22 (FIG. 3) is adapted to hold a release ring 24 (FIGS. 1–3) in place on a cylindrical surface 26 of the bullet B-1 before shooting. During entry into the formation the snap ring 22 is stripped out of the groove 20. When the bullet B-1 and sample are pulled from the formation, a tapered inner conical surface 24*a*, formed on the release ring 24 having a slope of approximately two degrees with respect to the cylindrical surface 26, assists in allowing the bullet B-1 to slip out of the release ring 24 to move clearly away therefrom.

A chamfer or tapered surface 28, usually on the order of forty-five degrees, is formed between the cylindrical surface 26 and a shoulder or stop surface 30. The chamfered surface 28 forms a surface against which a rear portion 24*b* of the release ring 24 is centered and also for centering the bullet B-1 and release ring 24 with respect to each other during entry into the formation. In this manner, the bullet B-1 penetrates perpendicularly into the formation rather than at some slight angle off of the perpendicular. Any misalignment of bullet at entry is felt to be one cause of early bullet failure. In this manner, longer service life is obtained and less bullet failure has been exhibited in experiments to date.

The stop surface 30 functions as a ram shoulder to ram or drive the release ring 24 into the formation. Preferably, several slots or radial grooves 32 are formed in the shoulder surface 30 about the periphery thereof to permit fluid to pass between the release ring 24 and the body of the bullet B-1 to insure against sticking between the release ring 24 and the body of the bullet B-1 which might inhibit release. Alternatively, when the release ring 24 is not used, the surface 30 serves as a stop or block member (FIG. 1).

A trailing surface 33 is formed over the rear portions of the bullet B-1 extending rearwardly from the shoulder surface 30. Typically, the amount of taper or slope of the surface 33 is on the order of two to fifteen degrees or so. The tapered surface has been found to exhibit superior service characteristics than the stepped rear or trailing surfaces found on bullets previously in use. First, the smooth transition of surface 33 rather than the abrupt stepped surfaces gives for a given diameter bullet greater mass and bulk and support for the stop surface 30. Further, the taper of the surface 33 tends to exhibit some degree of protection for the retriever cable which is connected by threaded screws inserted into threaded openings 34 formed in the body portion of the bullet B-1 interior of the tapering surface 33.

In addition to the threaded openings 34, conventional mud openings 38 are provided for passage of the drilling mud or other borehole fluid forced from the core barrel 10 as the formation rock enters. Also, connector pin openings 40 are formed in the body portion 36 of the bullet B-1 for alignment with a connector pin opening 42 of a tail plug or bottom cap C. An entry hole or socket 44 is formed in a rear portion of the body 36 of the bullet B for receipt of a mounting plug 45 through which the connector openings 40 and 42 is formed. The bottom cap C can then be connected to bullet B-1 with a pin. Preferably the pin should be a press fit in the pin opening 42 and a relatively loose fit in the bullet body 36 to eliminate the need for chamfers on the bullet body 36 coincident with holes 42 and thus reduce cost. It is also to be noted that a rear contact surface 46 formed on the bullet B-1 about the periphery of the connection with the bottom cap C is flat with no chamfer on inner or outer edges.

Considering now the bottom cap C more in detail, an optional rear charge chamber 50 can be incorporated to allow use of more powder. Alternatively, a plug or convex surface can be formed extending rearwardly from surface 50*a* to give the bullet more mass, and thus momentum, for better performance. Also, a flat rear surface co-planar with surface 50*a* may be formed on the cap C for added mass in lieu of the charge chamber, but less than the convex surface or plug. Each of these alternatives is a flat, continuous surface rather than having an opening therethrough as in the prior art to increase the mass and momentum of the bullet B-1.

Outer grooves 52 and 52*a* are provided so that normally surface 50*a* is flat. O-rings or other suitable seals may be inserted to seal the explosive in the sampling tool from borehole fluids. A substantially flat contact surface 60 is formed about the periphery of the cnnecting plug 45 to engage the flat surface 46 on the rear of the bullet B-1 to insure that substantially flat contact is achieved across the two impact surfaces. Additionally, the bottom cap C has a reduced diameter groove 61 formed at the transition between the mounting plug 45 and the flat contact surface 60. So far as is known to applicant, prior mounting caps have formed a chamfered surface at this transition that causes higher stress and more chance for failure at contact surfaces 60 and 46.

The barrel 10 of the core of the bullet interior extends along a cylindrical surface 64 rearwardly from the nose flat 12 for a first portion of its length thereof. At a transition point 66, an outwardly tapering surface 68 is formed. Applicant has found several advantages from this structure in bullets according to the present invention. The cylindrical surface portion 64 serves as a binding surface, blocking the core sample from falling downwardly through the bullet B-1 into the wellbore as the sampling tool is being drawn upwardly through the wellbore to the surface. Further, the tapered surface 68, even with a degree of taper of only one to five degrees or so, forms a pocket to hold loose small pieces of core sample, much in the manner of a funnel. Further, the surface 68 allows the core sample to go deeper into the bullet for the same amount of explosive power. Additionally, the core sample moves more easily into the core barrel 10 after initial rock penetration. Finally, when the bullet B-1 is at the surface, the outwardly tapering surface allows the core sample to be more easily forced with less damage from the bullet B-1 than with the prior continuously cylindrical bores.

In another bullet B-2 of the present invention (FIG. 6), like structure to that of the bullet B-1 bears like reference numerals. As with the bullet B-1, a cap C (FIG. 5) of the type described above is used. Further, the bullet B-2 is connected to the sampling tool by conventional cables inserted into threaded openings 90. The bullet B-2 has a rounded contact nose 92 and is adapted for use in harder rock formations than bullet B-1. With the rounded nose 92 in the bullet B-2, better penetration with less damage of rock formations has been found to occur than with the knife- or pointed-edge bullets of the prior art. A rearwardly outwardly tapering surface 94, typically on the order of fifteen degrees with respect to the longitudinal axis of the bullet B-2 extends from the nose 92. The surface 94 compresses and opens the formation rock as the bullet B-2 enters into the rock so that the core sample entering the opening 10 is separated from the formation. An arcuate ramp surface 96 is formed extending outwardly from the tapered surface 94. The ramp surface 96 functions as a stopping brake for the bullet B-2 during latter stages of entry into the formation. Additionally, the ramp surface 96 provides additional mass for penetration of the rounded nose 92. Finally the ramp 96 protects the retriever cable and cable studs connected at the threaded openings 90. An inwardly tapering outer surface portion 98 extends rearwardly from ramp surface 96 at an angle of about fifteen degrees from the longitudinal axis of the bore 10. A conical surface 99 having an included angle of about 110° is formed from access to the openings 90. Finally, as with the bullet B-1, mud ports 38 are provided, along with connector passages 40 and a rear contact flat surface 46.

Figure 7:
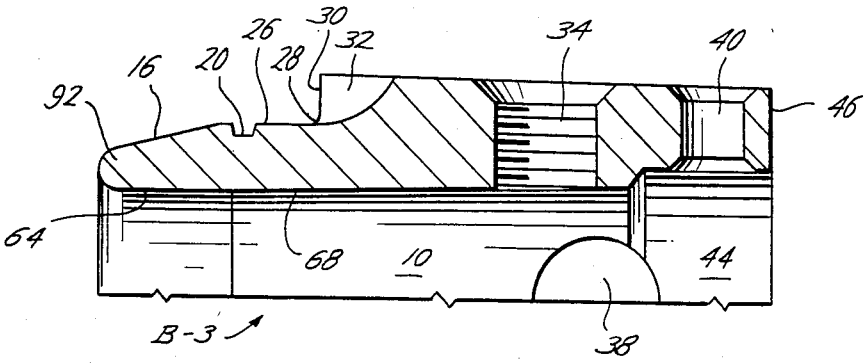

It should be understood that the foregoing two embodiments of bullets according to the present invention may be readily adapted into many and various other forms. For example, in an embodiment B-3 (FIG. 7) the rounded nose 92 of the bullet B-2 is formed on a body portion of a bullet of like sturcture to the embodiment B-1 (FIGS. 1–4). Accordingly, those portions of the bullet B-3 of like structure and function to the bullet B-1 bear like reference numerals, while those portions of the bullet B-3 of like structure to the bullet B-2 bear like reference numerals.

Figure 8:
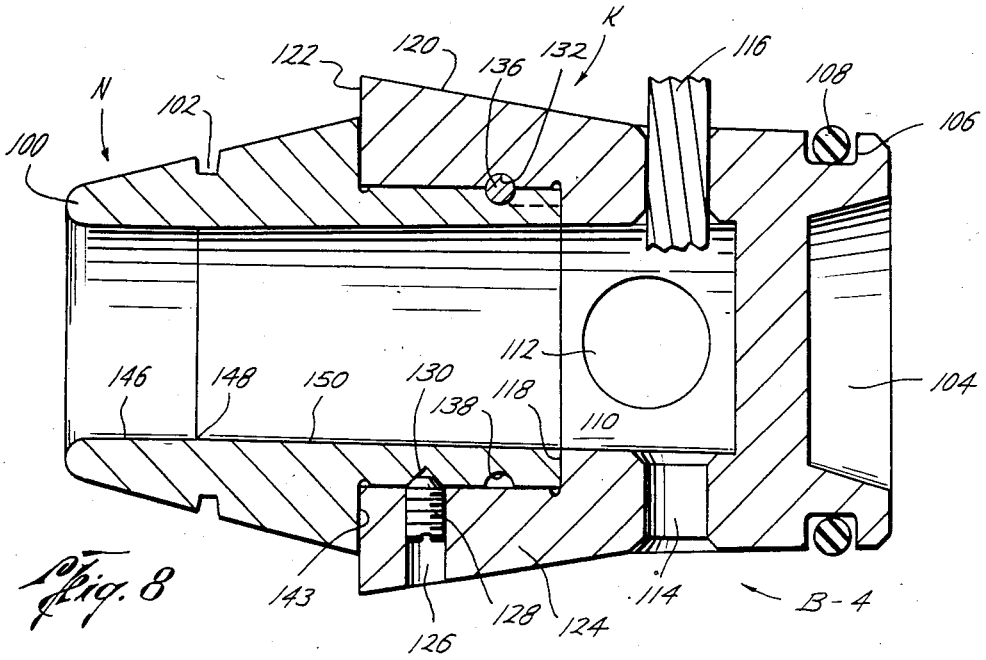
Figure 9:
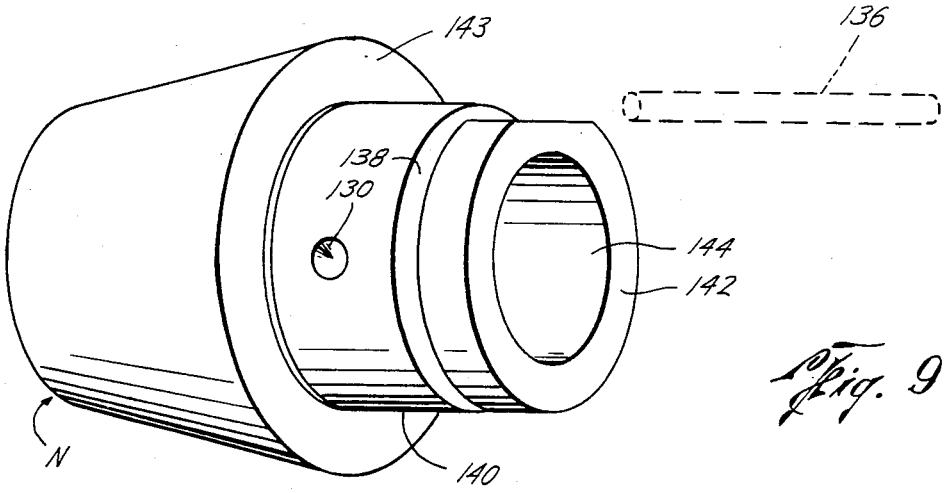
FIG. 9 is an isometric view of a changeable nose portion of the sampling bullet of FIG. 8.

In yet another embodiment of the present invention, a bullet B-4 with a removable nose N is provided. In the bullet B-4, a carrier K is provided and is adapted to receive any of a number of bullet noses of selected shape, such as the nose or front portions 12 and 14 of bullet B-1 or rounded nose 92 of bullet B-2. For example, in the embodiment shown in FIG. 8, a nose 100 similar in structure and function to the rounded nose 92 (FIG. 6) is releasably connected to the carrier K. A groove 102 for receipt of a snap ring so that a retainer ring may be used is also formed in the nose N (Similar to FIG. 3).

The carrier K has a rear charge cup 104 formed thereon and a groove 106 for receipt of a sealing member, such as an O-ring 108, to protect the explosive charge in the sampling tool from contact with borehole fluids. The carrier K has a central interior cup 110 in fluid communication through a mud port 112 with the well bore so that well fluids and mud may pass from the carrier K as the bullet B-4 is entering the formation. Openings 114 are formed in the carrier K for passage of a connector cable interconnecting the carrier K with the sampling tool. Rather than threaded connectors used in the other embodiments of the invention, a connector cable 116 with the carrier K is connected at each end to the sampling tool and passes therefrom through each of the openings 114 and back to the sampling tool for connection by threaded screws in the conventional manner.

The carrier K further has a flat contact surface 118 adapted to transfer the force from the charge chamber 104 caused by the explosive detonated to the nose N. As in the other bullets of the present invention, a rearwardly inwardly tapering surface 120 is formed on trailing portions of the carrier K for protection of the cable connection. A flat surface 122 is formed on front portions of carrier K to form an abrupt stop, to serve as a release ring seat, and to provide a contact area 143 in the nose N. A front body portion 124 rearwardly of impact flat is present to provide mass.

The nose N and the carrier K may be connected in several alternative manners. For example, a passage 126 may be formed for insertion of a set screw 128 which engages a corresponding dimple 130 in the nose N to interconnect with the carrier K. Alternatively, a hole 132 may be formed through the body portion 124 of the carrier K for insertion of a pin 136 which rides in a corresponding groove 138 in a rear body portion 140 of the nose N. The body 140 of the nose N has a rear contact flat 142 for contact with contact flat 122. Further, an outer contact flat 143 is formed between the contact surface 118 and the nose N for further transfer of force. Again, it is to be noted that a core barrel 144 of nose N is generally cylindrical for a first portion of its length 146 and then exhibits at a transition point 14B a gentle outward taper along an outwardly tapering surface 150 as is the case in the other bullets of the present invention.

The foregoing disclosure and description of the invention are illustrative and explanatory thereof, and various changes in the size, shape and materials, as well as in the details of the illustrated construction may be made without departing from the spirit of the invention.

I claim:

1. In a formation sampling bullet adapted to be fired at high speed by an explosive charge from a support apparatus into an earth formation adjacent to a well borehole to penetrate the formation with a nose portion to obtain and hold a formation sample core in a longitudinal bore extending rearwardly from said nose portion of said bullet, the bullet comprising:

(a) an initial contact nose portion about a longitudinal bore terminating at a circular opening of specified diameter at said nose portion, said nose portion defining a cutting edge around said opening;

(b) an encircling wall defining the body of said bullet surrounding said longitudinal bore to define said bore to the rear of said nose portion;

(c) an internal cylindrical surface defining said longitudinal bore, said surface defining a forward bore portion of right cylindrical configuration serially connected with an intermediate bore portion defined by a diverging internal cylindrical wall, and wherein said intermediate bore portion opens into a rear bore portion adapted to receive a closure means therein and wherein said longitudinal bore has a centered longitudinal axis and wherein said intermediate bore portion tapers outwardly with respect to said longitudinal axis of said longitudinal bore;

(d) said encircling wall increasing in thickness wherein the increased thickness defines an outer face curving away from the inner face of said wall;

(e) said nose portion, in longitudinal sectional view, being a rounded surface intersecting said outer face and said internal cylindrical surface;

(f) said outer face extending outwardly and rearwardly to define a surrounding shoulder, said shoulder including said outer face as the leading face thereof and also including a rear face on said shoulder encircling said bullet body wherein said rear face angles inwardly with respect to said longitudinal axis of said longitudinal bore;

(g) tail plug seating surface means at said rear bore portion which enables a closure.means to be seated thereagainst;

(h) mounting means for securing said closure means to said bullet body for receiving the force of an explosive charge for said bullet; and (i) wherein said bullet body has a flat annular circular face formed at a rear portion thereof and extending outwardly from said mounting means for receiving the force of the explosive charge on firing said bullet.

2. The apparatus of claim 1 including holes drilled into said encircling wall to the rear of said surrounding shoulder and adapted to receive at a sheltered location a connective means extendable to a bullet firing gun.

3. The formation sampling bullet of claim 1 wherein said intermediate bore portion tapers outwardly at an angle of substantially one degree with respect to said longitudinal axis of said longitudinal bore.

4. The formation sampling bullet of claim 1 further including a radius of curvature defining said nose portion leading edge.

5. The formation sampling bullet of claim 4 wherein:

(a) said closure means has a mounting plug member for insertion into a mounting pocket in said bullet body for connection therewith;

(b) said closure means further having a flat impact transfer surface extending outwardly and located rearwardly from said mounting plug member and adjacent thereto; and (c) an annular groove formed about said mounting plug member adjacent said impact transfer surface.

6. The apparatus of claim 1 further including;

(a) holes drilled into said encircling wall to the rear of said surrounding shoulder and adapted to receive at a sheltered location a connective means extendible to a bullet firing gun;

(b) wherein said intermediate bore portion tapers outwardly at an angle of substantially one degree with respect to said longitudinal axis of said longitudinal bore;

(c) further including a radius of curvature defining said nose portion leading edge;

(d) said closure means having a mounting plug member for insertion into a mounting pocket in said bullet body for connection therewith and further having a flat impact transfer surface extending outwardly and located rearwardly from said mounting plug member and adjacent thereto; and (e) an annular groove formed about said mounting plug member adjacent said impact transfer surface.

7. In a formation sampling bullet adapted to be fired by an explosive charge into an earth formation adjacent a well borehole to penetrate the formation with a nose portion and to obtain a formation sample core in a longitudinal bore extending rearwardly from said nose portion of said bullet, the bullet comprising:

(a) a mounting pocket formed in said bullet rearwardly of and coaxially with said sample bore for receipt of tail plug means;

(b) tail plug means for mounting in said mounting pocket for transferring the force of the explosive charge to said bullet;

(c) said tail plug means having a mounting cap member for insertion into said mounting pocket in said bullet for connection therewith;

(d) said tail plug means further having a flat contact surface extending outwardly at a location rearwardly from said mounting cap member and adjacent thereto;

(e) an annular groove formed about said mounting cap member adjacent to said contact surface to prevent any chamfer at the transition between said mounting cap member and said contact surface; and (f) wherein said longitudinal bore has first and second portions, said second portion defined by a diverging internal cylindrical wall tapering outwardly at an angle of less than 5° with respect to the longitudinal axis of said second portion to receive and hold a sample loosely therein after said sample has passed through said first portion.

8. The formation sampling bullet of claim 7 further including:

said bullet having a flat annular disk surface formed on a rear portion thereof for receiving the force of the explosive charge from said tail plug means.

9. The formation sampling bullet of claim 7 wherein:

said nose portion of said bullet has a rounded contact surface for penetration of the formation.

10. The formation sampling bullet of claim 7 wherein:

said nose portion of said bullet has a flat initial contact surface and an outwardly tapering wedging surface adjacent thereto for penetration of the formation.

11. In a formation sampling bullet adapted to be fired by an explosive charge into an earth formation adjacent to a well borehole to penetrate the formation with a nose portion and to obtain a formation sample core in a longitudinal bore extending rearwardly of said nose portion of said bullet, the bullet comprising:

(a) a bullet body having an outer face;

(b) a nose portion thereon encircling a longitudinal bore in said body, said bore having an internal bore surface;

(c) said nose portion, in longitudinal sectional view, being a rounded surface intersecting (1) said internal bore surface, and (2) said outer face on said body;

(d) a mounting pocket formed in said bullet body rearwardly of and coaxially of said longitudinal bore;

(e) tail plug means for mounting in said mounting pocket for transferring the force of the explosive charge to said bullet body;

(f) said outer face extending outwardly and rearwardly to define a surrounding shoulder, said shoulder including said outer face as the leading face thereof and also including a rear face on said shoulder encircling said bullet body wherein said rear face angles inwardly with respect to a longitudinal axis of said longitudinal bore; and (g) said bullet body extending rearwardly of said shoulder to said mounting pocket.

* * * * *